US006299731B1

(12) United States Patent
Begemann et al.

(10) Patent No.: US 6,299,731 B1
(45) Date of Patent: Oct. 9, 2001

(54) PROCESS AND HEADBOX SYSTEM FOR IMPROVING CONSISTENCY CROSS-DIRECTION PROFILE OF FIBER WEB

(75) Inventors: Ulrich Begemann; Dirk Thomas, both of Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/401,951

(22) Filed: Sep. 23, 1999

(30) Foreign Application Priority Data

Sep. 24, 1998 (DE) ..... 198 43 727

(51) Int. Cl.[7] ..... D21F 1/08

(52) U.S. Cl. ..... 162/216; 162/336; 162/258; 162/259

(58) Field of Search ..... 162/123, 125, 162/183, 185, 189, 190, 198, 199, 212, 216, 252, 253, 258, 259, 263, 264, 272, 336, 337, 338, 341, 342, 343

(56) References Cited

U.S. PATENT DOCUMENTS

| | | | | |
|---|---|---|---|---|
| 4,940,512 | * | 7/1990 | Hendren et al. | 162/109 |
| 5,316,383 | | 5/1994 | Begemann et al. . | |
| 5,401,363 | | 3/1995 | Begemann et al. . | |
| 5,560,807 | | 10/1996 | Hauser . | |
| 5,674,363 | * | 10/1997 | Huovila et al. | 162/216 |
| 5,707,495 | | 1/1998 | Heinzmann et al. . | |
| 5,885,420 | | 3/1999 | Heinzmann et al. . | |
| 6,117,272 | * | 9/2000 | Heinzmann | 162/216 |

FOREIGN PATENT DOCUMENTS

| | | |
|---|---|---|
| 4019593 | 1/1992 | (DE) . |
| 94019593 | 1/1992 | (DE) . |
| 4323263 | 1/1994 | (DE) . |
| 4211290 | 7/1994 | (DE) . |
| 4211291 | 7/1994 | (DE) . |
| 19843729 | 3/2000 | (DE) . |
| 600251 | 6/1994 | (EP) . |
| 824157 | 2/1998 | (EP) . |

* cited by examiner

*Primary Examiner*—Stanley S. Silverman
*Assistant Examiner*—Eric Hug
(74) *Attorney, Agent, or Firm*—Greenblum & Bernstein, P.L.C.

(57) ABSTRACT

Process and apparatus for improving a consistency cross-direction profile of a fiber web in the wet section. The process includes distributing a fiber suspension across a machine width from a headbox to one of on a wire and between two wires, adjusting a cross-sectional basis weight by sectionally mixing, across the machine width, a first suspension having a first solid content and a first percentage composition and a second suspension having second solid content that is one of lower and higher than the first solid content, and a second percentage composition of the solids content of the second suspension differs from the first percentage composition, and sectionally admixing at least a third suspension across the machine width, the third suspension having a solids content that is one of lower and higher than the solids content of at least one of the first and second solids content, and having a third percentage composition that differs from at least one of the first and second percentage compositions. The apparatus includes one of a first machine-wide feed and a first set of individual feeds for the first suspension, a second set of individual feeds for the second suspension, control devices coupled to the second set of individual feeds for regulating a flow of the second suspension, a turbulence generator, a headbox nozzle. At least a third set of individual feeds for a third suspension is positioned at least one of upstream from the turbulence generator and to act equally on each section across the machine width. The third suspension has a solids content that differs from the solids contents of the first and second suspensions, and additional control devices coupled to the third set of individual feeds for regulating a flow of the third suspension.

30 Claims, 3 Drawing Sheets

PROCESS AND HEADBOX SYSTEM FOR IMPROVING CONSISTENCY CROSS-DIRECTION PROFILE OF FIBER WEB

CROSS-REFERENCE TO RELATED APPLICATIONS

The present application claims priority under 35 U.S.C. §119 of German Patent Application No. 198 43 727.7, filed Sep. 24, 1998, the disclosure of which is expressly incorporated by reference herein in its entirety.

BACKGROUND OF THE INVENTION

1. Field of the Invention

The present invention relates to a process and headbox system for improving the consistency cross-direction profile of a fiber web, e.g., a paper or cardboard web, in a wet process. The process includes distributing, via the headbox, a fiber suspension across a width of the machine onto either a wire or between two wires, and at least partially adjusting a cross-direction basis weight that is sectionally variable across the machine width. The adjustment of the cross-direction basis weight includes mixing a first suspension having a first solid content and a first percentage composition of solids content with a second suspension having a second solid content, which is lower or higher than the first solid content. A second percentage composition of the solids content of the second suspension is different from the first percentage composition.

2. Discussion of Background Information

U.S. Pat. No. 5,560,807 discloses sectionally feeding a suspension with additives, chemical admixtures, or weighting agents in a regulated manner in a diaphragm-controlled headbox in the area of a lateral distributor. In this manner, with respect to the z-direction of the resulting web or paper, the concentration of admixtures can be adjusted and the feed of the admixtures can take place as close as possible to the outlet of the headbox. Thus, a change in the admixtures due to an excessively long dwell time in the pulp slurry can be prevented.

Commonly assigned German patent disclosure document DE 40 19 593 A1 discloses a sectional consistency-regulated headbox having two sets of individual feeds for two pulp slurries of differing solids content which are distributed across the machine width. Preferably, pulp stock and backwater are used in this process. When the basis weight cross-direction profile of the paper web deviates at a specific position of the web width, the concentration CM of the sectional flow corresponding to this specific position is corrected by changing the quantitative proportion of the regulating flows of differing solids content $Q_H/Q_L$ fed to a mixer. This type of basis weight cross-direction profile regulation is very advantageous with respect to a simultaneously good fiber orientation cross-direction profile, and yields very good results with regard to basis weight cross-direction profile. However, as requirements concerning paper quality are constantly increasing, it is clear that papers manufactured in this way can exhibit striped wild formations with respect to their printability despite even fiber orientation and even basis weight. Detailed studies have shown that this uneven printability is attributable to an uneven composition of the paper.

U.S. Pat. No. 5,401,363 and its counterpart European patent document EP 0600 251 B1 discloses sectionally feeding differing quantities of a retention agent to the headbox across the machine width to eliminate an uneven consistency crossdirection profile of a paper web arising through wear on the wires of differing intensity. However, a process of this type is unsuccessful if the original consistency of the pulp slurry is already uneven across the machine width.

SUMMARY OF THE INVENTION

Therefore, the present invention provides a process and a headbox system that improves the consistency cross-direction profile of a fiber web, e.g., a paper or cardboard web.

The process, according to the present invention, includes sectionally admixing, across the machine width, at least a third suspension having a third solids content, which has either a lower or higher solids content than the first and/or second suspensions. Moreover, a third percentage composition of the solids content of the third suspension differs from the first and/or second percentage compositions.

The headbox system of the present invention includes at least a third set of individual feeds with flow regulating elements for feeding the third suspension, the at least a third set of individual feeds being positioned upstream from a turbulence generator and/or to act equally per section in a z-direction of the fiber web. The third percentage composition of solids of the third suspension can differ from the first and/or second percentage compositions.

Accordingly, the present invention provides a process for manufacturing a fiber web, e.g., a paper or cardboard web, in a wet process in which the fiber suspension is distributed by a headbox across the width of the machine onto a wire or between two wires. The basis weight cross-direction profile, which is sectionally variable across the machine width, is at least partly influenced or adjusted by a mixture of the first suspension $Q_1$ having a first solids content and a first percentage composition of the first solids content, and the second suspension $Q_2$ having a second solids content which is lower or higher than the first solids content. A second percentage composition of the second solids content differs from the first percentage composition. At least a third suspension $Q_3$, having a third solids content which is lower or higher than the first and/or second solids content, is sectionally admixed across the machine width. The third percentage composition of the third solids content differs from the first and/or second percentage composition.

Through a corresponding variation of the mixture of at least three suspensions of differing compositions, the process of the present invention enables influencing or adjustment of a sectional overall volume flow that, despite a reduction or increase in the overall solids content in the section, maintains a constant percentage composition of individual solid components. However, the influence or adjustment of a specific retention, which changes with respect to the individual solids content based on the differing overall solids content in the suspension, can be offset by targeted influencing or adjustment of the initial composition of the fed pulp slurry.

In a particularly advantageous embodiment of the instant invention, normal pulp slurry (pulp stock) can be utilized as first suspension $Q_1$, backwater can be utilized as second suspension $Q_2$, and clarified filtrate, clarified water, diluted retention agent, backwater from other parts of the wire section, first suspension $Q_1$, and/or any combinations thereof can be utilized as third suspension $Q_3$.

Moreover, the suspensions may also differ in content of weighting agent and/or fiber content. It is also possible that the suspensions may differ in content of fibers of different lengths and/or content of fibers having a different shrinkage effect on the fiber web in the subsequent manufacturing process. In this context, reference is made to commonly owned German patent application 198 43 729.4 and counterpart U.S. patent application Ser. No. 09/401,952 filed Sep. 23, 1998, the disclosure of which is expressly incorporated by reference herein in its entirety.

In an exemplary embodiment of the process, second suspension $Q_2$ can be structured or formed to mainly or exclusively include fiber content, and third suspension $Q_3$ can be structured or formed to mainly or exclusively include weighting agent content. In this manner, at a specific mixing ratio of the second and third suspensions, i.e., $Q_2/Q_3$, a composition of solids can be achieved that corresponds to the composition of solids of first suspension $Q_1$, but which has a different concentration of solids. Thus, by simply maintaining the mixing, ratio, the composition of solids can be kept constant while enabling different quantitative proportions to be set with respect to first suspension $Q_1$. Therefore, a targeted shifting, of the mixing, ratio of the second and third suspensions $Q_2/Q_3$ can cause a shift in the composition of solids toward weighting, agents or fibers.

Additionally, if a same percentage by mass of solids (solids content) is selected in the first and second suspensions $Q_1$ and $Q_2$, a shift in the mixing, ratio of the second and third suspensions $Q_2/Q_3$, at a constant cumulative volume flow Of $Q_2+Q_3$, does not result in any change in the overall solids content of the overall volume flow of the first, second, and third suspensions. Further, assuming that retention and shrinkage performance remain uinchanged, no change results in the basis weight of the corresponding section of the finished fiber web. Such an embodiment particularly affects the complexity of regulation/control processes and permits regulation that is easy or relatively easy to program since the reciprocal effects of changes in individual volume flow ratios are kept within limits.

In another exemplary embodiment of the process according to the invention, second suspension $Q_2$ can mainly include fiber content having, a high shrinkage tendency, third suspension $Q_3$ can mainly include fiber content having, a low shrinkage tendency, a fourth suspension $Q_4$ can mainly include weighting agent content, and a fifth suspension $Q_5$ can include a retention agent. The combination of the additional suspensions can be made in accordance with the features of the above-discussed embodiments of the present invention.

The present invention also relates to an apparatus for performing the above-discussed process. A headbox system of a paper or cardboard machine provides sectional consistency regulation across a machine width by variable mixing of a first and a second suspension having differing concentrations of solids (solids contents). The apparatus can include a first machine-wide feed or a first set of individual feeds supplying the first suspension, a second set of individual feeds supplied with agents that influence or adjust the flow of the second suspension, a turbulence-generating section, and a nozzle section. Moreover, at least a third set of individual feeds supplied with agents affecting flow of a third suspension can be coupled upstream from the turbulence-generating section and/or equally acting per section in a z-direction of the fiber web. A composition of solids of the third suspension differs from the first and/or second suspensions in the manner discussed above with respect to the process.

Therefore, the present invention is directed to a process for improving a consistency cross-direction profile of a fiber web in the wet section. The process includes distributing a fiber suspension across a machine width from a headbox to one of on a wire and between two wires, adjusting a cross-sectional basis weight by sectionally mixing, across the machine width, a first suspension having a first solid content and a first percentage composition and a second suspension having second solid content that is one of lower and higher than the first solid content, and a second percentage composition of the solids content of the second suspension differs from the first percentage composition, and sectionally admixing at least a third suspension across the machine width, the third suspension having a solids content that is one of lower and higher than the solids content of at least one of the first and second solids content, and having a third percentage composition that differs from at least one of the first and second percentage compositions.

According to another feature of the present invention, the first suspension can include pulp slurry, the second suspension can include backwater, and the third suspension can include clarified filtrate, clarified water, or diluted retention agent. Moreover, the first, second, and third suspensions can include different weighting agent contents, different fiber contents, a content of fibers having different lengths, or a content of fibers having a different shrinkage effect on the fiber web in a subsequent manufacturing process.

In accordance with another feature of the instant invention, the second suspension can be composed mainly of fiber content and the third suspension can be composed mainly of weighting agent content.

In accordance with a further feature of the invention, the process can further include admixing a fourth suspension with the third suspension. The second suspension can be composed mainly of a fiber content having a high shrinkage tendency, the third suspension can be composed mainly of a fiber content having a low shrinkage tendency, and the fourth suspension can be composed of mainly a weighting agent content. Further, the process can include admixing a fifth suspension with at least one of the third and fourth suspensions. The fifth suspension can include a retention agent.

In accordance with still another feature of the invention, a sectional volume flow of the individual suspensions may be at least partially at least one of regulated and controlled. Further, the sectional volume flow of the individual suspension can be entirely at least one of regulated and controlled.

Further still, the fiber web can be composed of one of a paper and cardboard web.

According to yet another feature of the instant invention, the first suspension can include pulp slurry, the second suspension can include backwater, and the third suspension can include at least one of clarified filtrate, clarified water, and diluted retention agent. The first, second, and third suspensions can include at least one of different weighting agent contents, different fiber contents, a content of fibers having different lengths, a content of fibers having a different shrinkage effect on the fiber web in a subsequent manufacturing process. Moreover, the second suspension can be composed mainly of fiber content and the third suspension can be composed mainly of weighting agent content, or the process can include admixing a fourth suspension with the third suspension, in which the second suspension is composed mainly of a fiber content having a high shrinkage tendency, the third suspension is composed mainly of a fiber content having a low shrinkage tendency, and the fourth suspension is composed of mainly a weighting agent content, and admixing a fifth suspension with at least one of the third and fourth suspensions, in which the fifth suspension can include a retention agent.

The present invention is also directed to an apparatus for sectional consistency regulation across a machine width by mixing a first and a second suspension having differing solids contents. The apparatus includes one of a first machine-wide feed and a first set of individual feeds for the first suspension, a second set of individual feeds for the second suspension, control devices coupled to the second set of individual feeds for regulating a flow of the second suspension, a turbulence generator, a headbox nozzle. At least a third set of individual feeds for a third suspension is positioned at least one of upstream from the turbulence generator and to act equally on each section across the machine width. The third suspension has a solids content that differs from the solids contents of the first and second suspensions, and additional control devices coupled to the third set of individual feeds for regulating a flow of the third suspension.

In accordance with another feature of the present invention, the third set of individual feeds can be directly coupled to the second set of individual feeds, the second set of individual feeds can be directly coupled to the one of a first machine-wide feed and a first set of individual feeds, and the one of a first machine-wide feed and a first set of individual feeds can be directly coupled to a chamber of the headbox positioned upstream, relative to a suspension flow direction, from the turbulence generator.

According to still another feature of the instant invention, the second set of individual feeds may be directly coupled to the one of a first machine-wide feed and a first set of individual feeds, the one of a first machine-wide feed and a first set of individual feeds may be directly coupled to a chamber of the headbox positioned upstream, relative to a suspension flow direction, from the turbulence generator, and the third set of individual feeds may be directly coupled to the chamber of the headbox.

According to a further feature of the invention, a fourth set of individual feeds can be provided for a fourth suspension, and a fifth set of individual feeds can be provided for a fifth suspension. The third, fourth, and fifth sets of individual feeds may be coupled to the second set of individual feeds, the second set of individual feeds may be directly coupled to the one of a first machine-wide feed and a first set of individual feeds, and the one of a first machine-wide feed and a first set of individual feeds can be directly coupled to a chamber of the headbox positioned upstream, relative to a suspension flow direction, from the turbulence generator. Further, the first suspension can include pulp slurry, the second suspension can include a fiber content having a high shrinkage tendency, the third suspension can include a fiber content having a low shrinkage tendency, the fourth suspension can include a weighting agent content, and the fifth suspension can include a retention agent.

In accordance with a still further feature of the instant invention, the first suspension may include pulp stock, the second suspension may include backwater, and the third suspension may include clarified water.

The present invention is also directed to a process for adjusting a consistency cross-direction profile of a fiber web, in which the process includes supplying a suspension to pre-chamber of a headbox, and adjusting a solids content of the first suspension without affecting a percentage composition of solids in the first suspension. The adjusting includes combining a second suspension having a solids content and a percentage composition of solids that is different from the solids content and the percentage composition of solids of the first suspension and a third suspension having a solids content and a percentage composition of solids that is different from the solids content and the percentage composition of solids of at least one of the first and second suspensions.

According to another feature of the present invention, the process can further include mixing the second and third suspensions together, and supplying the mixture of the second and third suspensions to the first suspension. Further, the adjusting can include combining a fourth suspension to at least one of the second and third suspension. Further still, the adjusting can include combining a fifth suspension to at least one of the second, third, and fourth suspensions. The first suspension can include pulp slurry, the second suspension can include a fiber content having a high shrinkage tendency, the third suspension can include a fiber content having a low shrinkage tendency, the fourth suspension can include a weighting agent content, and the fifth suspension can include a retention agent.

In accordance with still another feature of the present invention, the process can also include mixing the second and first suspension together, supplying the mixture of the first and second suspensions to the headbox, and supplying the third suspension to the headbox.

In accordance with a still further feature of the present invention, the adjusting can include combining a fourth suspension to at least one of the second and third suspension. The adjusting may also include combining a fifth suspension to at least one of the second, third, and fourth suspensions.

The instant invention is also directed to an apparatus for sectional consistency regulation across a machine width. The apparatus includes one of a first machine-wide feed and a first set of individual feeds for the first suspension, a second set of individual feeds for the second suspension, and at least a third set of individual feeds for a third suspension positioned at least one of upstream from the turbulence generator and to act equally on each section across the machine width. The third suspension has a solids content that differs from the solids contents of the first and second suspensions.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1A:
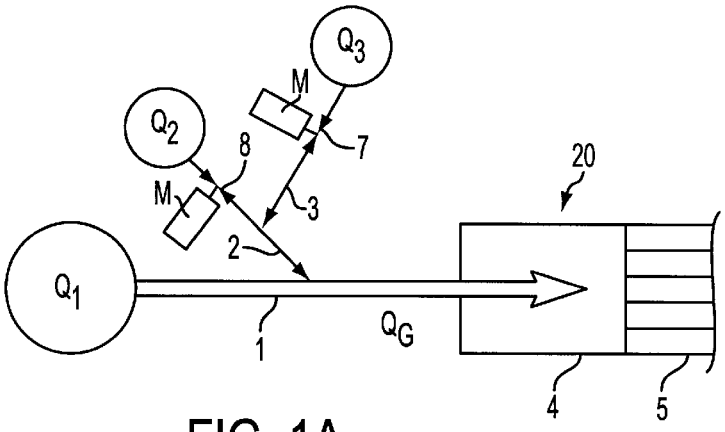
FIGS. 1A, 1B, and 1C schematically illustrate a suspension feed to a headbox according to the present invention, which includes three sets of feeds upstream from the headbox.
Figure 1B:
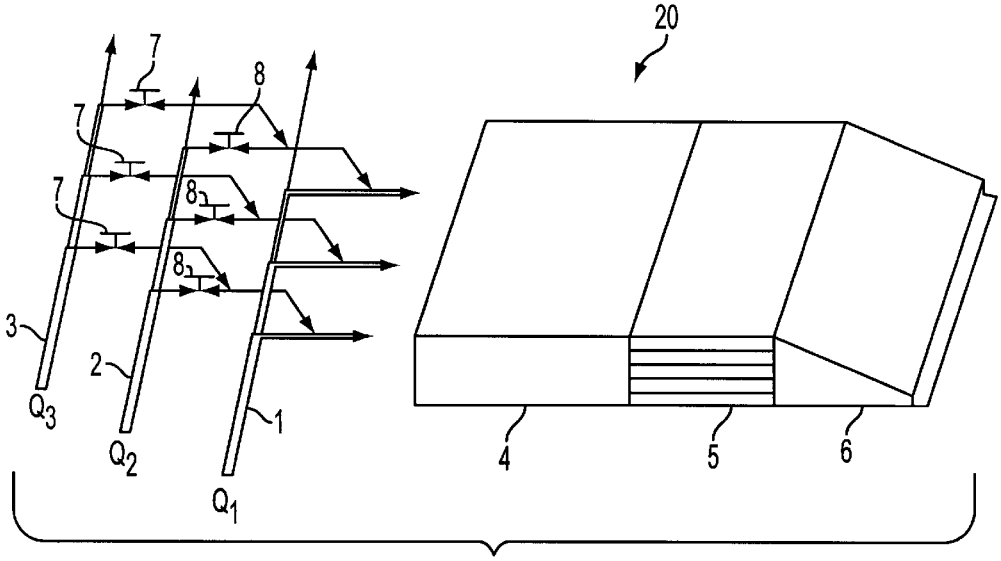
Figure 1C:
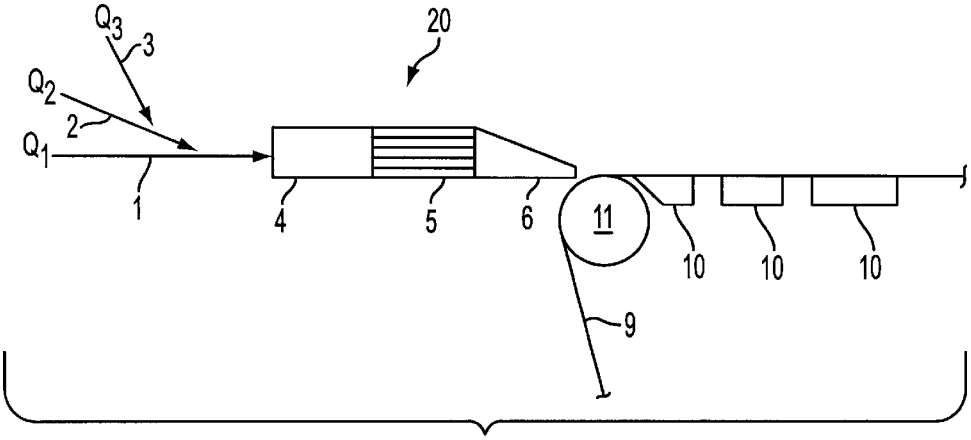

FIGS. 1A, 1B, and 1C schematically illustrate a suspension feed to a headbox 20, which includes a sectional mixing area (pre-chamber) 4, a turbulence generator 5, and a nozzle (slice) 6, through three sets of feeds 1, 2, and 3 located upstream from headbox 20. Feeds 1, 2, and 3, as depicted in FIG. 1B, can be sectionally arranged across a width of headbox 20. In this exemplary embodiment, three pulp slurries $Q_1$, $Q_2$, and $Q_3$, which can have different weighting agent contents and compositions, are mixed together into feed 1 through feeds 2 and 3. Specifically, sectional main flow Q1, e.g., pulp stock having a solids content of, e.g., between approximately 0.5 and 2.0% and a high proportion of weighting agent is fed in through feed 1. Two sectional suspension flows Q2, e.g., backwater having a solids content of, e.g., between approximately 0.2 and 1.5%, and Q3, e.g., clarified water having a solids content of, e.g., between approximately 0 and 0.5%, can be fed through feeds 2 and 3, respectively. It is noted that "solids content," also referred to as "concentration of solids" and "percentage by mass of solids," relates to the dry weight of the total solids in relation to the total weight of the suspension.

The backwater and clarified water flows, e.g., volume flow, may be respectively controlled or regulated by metering valves 7 and 8 in each section. Additionally, a sectional volume flow control or volume flow regulation (not shown) of the sectional overall volume flows $Q_G$, which is $Q_1+Q_2+Q_3$ can be provided through additional valves upstream or downstream from the sectional feeds of cumulative flows from backwater $Q_2$ and clarified water $Q_3$.

Accordingly, as shown in FIG. 1C, the sectional overall volume flow passes through turbulence generator 5 and is distributed, via nozzle 6, onto a wire 9 passing over breast roll 11. Draining devices 10 can be positioned below wire 9 to receive the water removed from the suspension on wire 9. Moreover, it is contemplated that headbox 20 can alternatively be utilized in a twin-wire former to deliver the suspension between two wires (not shown).

With regard to commonly owned German patents DE 42 11 291 C2 (as well as counterpart U.S. Pat. No. 5,316,383) and DE 42 11 290 C2, which disclose individual admixtures of partial flows into a main flow while maintaining a cumulative volume flow, the disclosures are expressly incorporated by reference herein in its entirety.

Figure 2A:
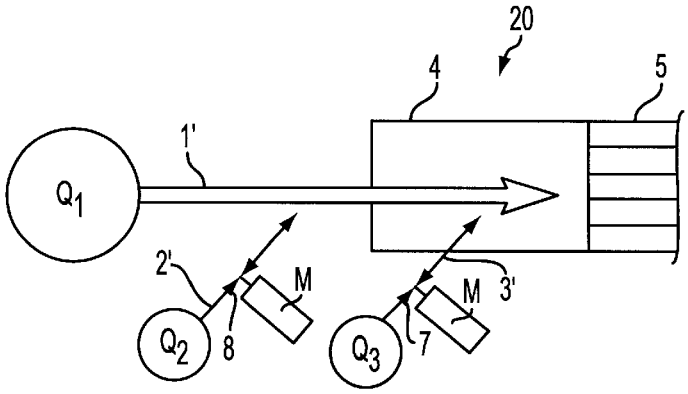
FIGS. 2A, 2B, and 2C schematically illustrate a suspension feed to the headbox according to the present invention, which includes two sets of feeds upstream from the headbox and one set of feeds in a chamber positioned upstream from the turbulence generator.
Figure 2B:
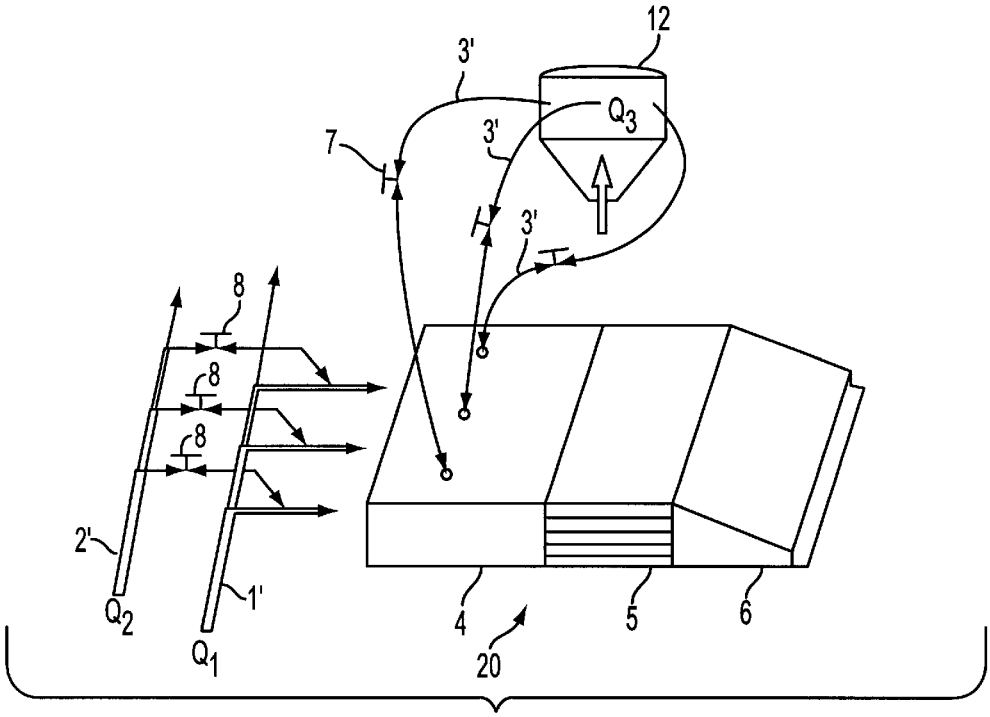
Figure 2C:
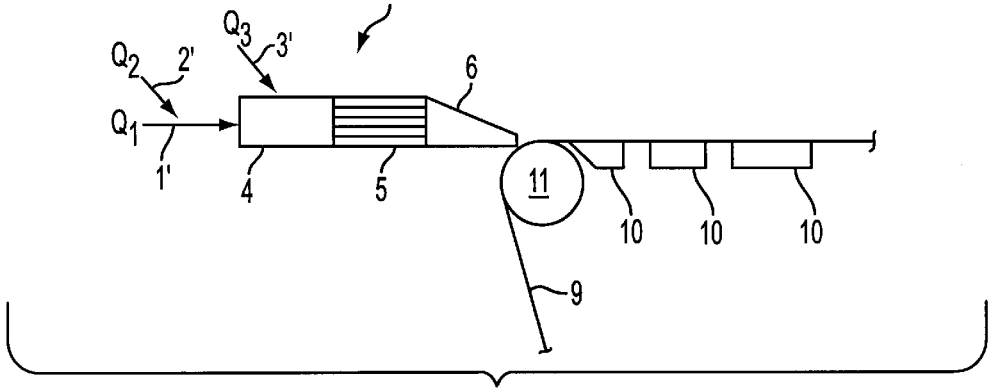

An alternative exemplary embodiment of the process and apparatus of the present invention is schematically illustrated in FIGS. 2A, 2B, and 2C. In contrast to FIGS. 1A–1C, this alternative embodiment illustrates the feeding of three different suspensions to headbox 20 in which two sets of feeds 1' and 2' are located upstream from headbox 20 and one set of feeds 3' is located within a chamber 4 of headbox 20 and upstream from turbulence generator 5 relative to the suspension flow direction.

A consistency-regulated headbox of a type generally known in the art includes to two sets of sectional feeds $Q_1$, e.g., including pulp stock, and $Q_2$, e.g., including backwater, which are combined upstream from headbox 20 itself. In accordance with the instant invention, a third set of sectional suspension flows $Q_3$, e.g., including clarified water $Q_3$, can be mixed into the combined pulp stock and backwater in pre-chamber 4 located upstream from turbulence generator 5. So that the admixture in this area of headbox 20 does not to produce any undesired changes in the sectional overall volume flows $Q_G$, either metered addition of clarified water $Q_3$ should occur at a particular angle so that the overall volume flow is not affected, or additional valves should be utilized to vary the added, sectional cumulative volume flow $Q_S$ from $Q_1+Q_2$. For example, the individual flows which form the overall volume flow $Q_G$ at the nozzle can be: $Q_1$ between approximately 60 and 100% of the total flow; $Q_2$ between approximately 0 and 40% of the total flow; and $Q_3$ between approximately 0 and 20% of the total flow.

Since the composition of the solids content, in terms of fibers and weighting agents, is different in backwater $Q_2$ and clarified water $Q_3$, headbox 20 can regulate the basis weight cross-direction profile by dilution, which permits a desired and specific sectional change in the composition of overall volume flow $Q_G$ fed in headbox 20.

Figure 3:
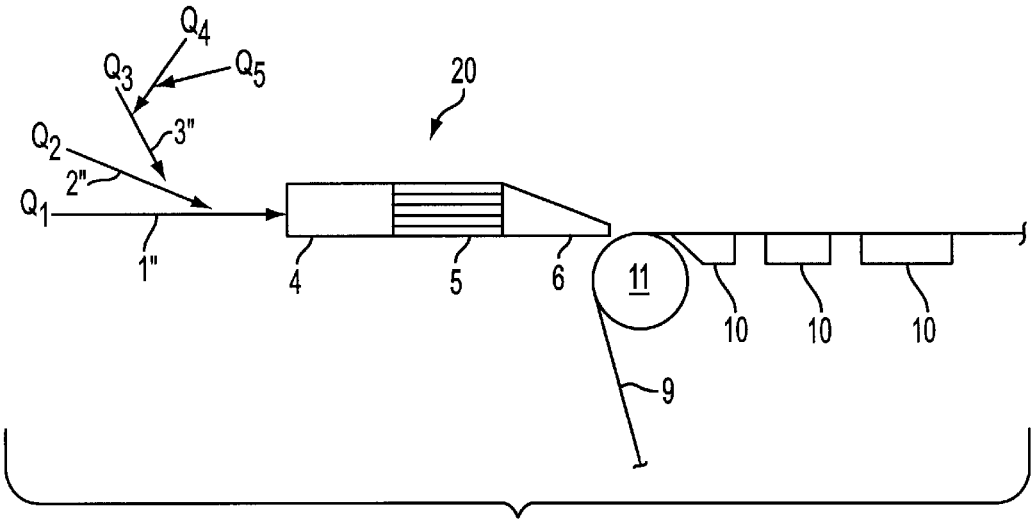
FIG. 3 schematically illustrates another arrangement that includes five sets of sectional feeds.

As shown in FIG. 3, additional feeds may be provided in accordance with the features of the present invention. For example, third suspension $Q_3$, which can, e.g., mainly include fiber content having a low shrinkage tendency, can be combined with a fourth suspension $Q_4$, which can, e.g., mainly include weighting agent content, and a fifth suspension $Q_5$, which can, e.g., include a retention agent. The combination of suspensions $Q_3$, $Q_4$, and $Q_5$ can be mixed with suspension $Q_2$, which can, e.g., mainly include fiber content having a high shrinkage tendency, through feed 3", and the resultant mixture can be combined with first suspension $Q_1$, which can, e.g., include pulp Slurry, through feed 2". The combination of these additional suspensions are made in accordance with the features of the above-discussed embodiments of the present invention such that the composition of solids to be combined with suspension $Q_1$ through feed 2" corresponds to the composition of solids of suspension $Q_1$. Thus, the percentage of individual solids to total solids in the resultant suspension input to pre-chamber 4, i.e., through feed 1", remains substantially the same, while the solids content can be adjusted. Alternatively, suspensions $Q_3$, $Q_4$, and $Q_5$ can be added directly to pre-chamber 4 in the manner discussed with regard to FIGS. 2A–2C It is noted that the sectioning of the suspension feeds, as shown in the exemplary figures, into three sections represents a principle of present invention, but that in a practical embodiment, significantly smaller subdivisions into significantly more sections is contemplated. Moreover, the width of the individual sections can differ across the machine width. For example, in an edge area of the machine width, a smaller division may be selected than in a middle area, since the greatest error gradient most often occurs in the edge areas. In contrast, a smaller quantity of errors in relation to width is to be expected in the middle area.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Numbers

1 first set of suspension feeds
2 second set of suspension feeds
3 third set of suspension feeds
4 pre-chamber
5 turbulence generator
6 headbox nozzle (slice)
7 metering valve
8 metering valve
9 wire
10 drainage devices
11 breast roll
12 clarified water container
20 headbox
$Q_1$ first suspension flow with high concentration/pulp stock
$Q_2$ second suspension flow with low concentration/backwater
$Q_3$ third suspension flow with different composition of paper/clarified water
$Q_4$ fourth suspension flow
$Q_5$ fifth suspension flow
$Q_G$ overall volume flow
$Q_S$ cumulative volume flow

What is claimed:

1. A process for improving a consistency cross-direction profile of a fiber web in the wet section, the process comprising:

distributing a fiber suspension across a machine width from a headbox to one of on a wire and between two wires;

adjusting a cross-sectional basis weight by sectionally mixing, across the machine width, a first suspension having a first solid content and a first percentage composition and a second suspension having second solid content that is one of lower and higher than the first solid content, and a second percentage composition of the solids content of the second suspension that differs from the first percentage composition; and sectionally admixing at least a third suspension across the machine width, the third suspension having a solids content that is one of lower and higher than the solids content of at least one of the first and second solids content, and having a third percentage composition that differs from at least one of the first and second percentage compositions.

2. The process in accordance with claim 1, wherein the first suspension comprises pulp slurry.

3. The process in accordance with claim 1, wherein the second suspension comprises backwater.

4. The process in accordance with claim 1, wherein the third suspension comprises clarified filtrate.

5. The process in accordance with claim 1, wherein the third suspension comprises clarified water.

6. The process in accordance with claim 1, wherein the third suspension comprises diluted retention agent.

7. The process in accordance with claim 1, wherein the first, second, and third suspensions comprise different weighting agent contents.

8. The process in accordance with claim 1, wherein the first, second, and third suspensions comprise different fiber contents.

9. The process in accordance with claim 1, wherein the first, second, and third suspensions comprise a content of fibers having different lengths.

10. The process in accordance with claim 1, wherein the first, second, and third suspensions comprise a content of fibers having a different shrinkage effect on the fiber web in a subsequent manufacturing process.

11. The process in accordance with claim 1, wherein the second suspension is composed mainly of fiber content and the third suspension is composed mainly of weighting agent content.

12. The process in accordance with claim 1, further comprising:

admixing a fourth suspension with the third suspension, wherein the second suspension is composed mainly of a fiber content having a high shrinkage tendency, the third suspension is composed mainly of a fiber content having a low shrinkage tendency, and the fourth suspension is composed of mainly a weighting agent content.

13. The process in accordance with claim 12, further comprising:

admixing a fifth suspension with at least one of the third and fourth suspensions, wherein the fifth suspension comprises a retention agent.

14. The process in accordance with claim 1, wherein a sectional volume flow of the individual suspensions is at least partially at least one of regulated and controlled.

15. The process in accordance with claim 14, wherein the sectional volume flow of the individual suspension is entirely at least one of regulated and controlled.

16. The process in accordance with claim 1, wherein the fiber web is composed of one of a paper and cardboard web.

17. The process in accordance with claim 1, wherein the first suspension comprises pulp slurry, the second suspension comprises backwater, and the third suspension comprises at least one of clarified filtrate, clarified water, and diluted retention agent, and wherein the first, second, and third suspensions comprise at least one of different weighting agent contents, different fiber contents, a content of fibers having different lengths, a content of fibers having a different shrinkage effect on the fiber web in a subsequent manufacturing process.

18. The process in accordance with claim 17, wherein the second suspension is composed mainly of fiber content and the third suspension is composed mainly of weighting agent content.

19. The process in accordance with claim 17, further comprising:

admixing a fourth suspension with the third suspension, wherein the second suspension is composed mainly of a fiber content having a high shrinkage tendency, the third suspension is composed mainly of a fiber content having a low shrinkage tendency, and the fourth suspension is composed of mainly a weighting agent content; and admixing a fifth suspension with at least one of the third and fourth suspensions, wherein the fifth suspension comprises a retention agent.

20. A process for adjusting a consistency cross-direction profile of a fiber web, the process comprising:

supplying a suspension to a pre-chamber of a headbox; and adjusting a solids content of the first suspension without affecting a percentage composition of solids in the first suspension, wherein the adjusting includes combining a second suspension having a solids content and a percentage composition of solids that is different from the solids content and the percentage composition of solids of the first suspension and a third suspension having a solids content and a percentage composition of solids that is different from the solids content and the percentage composition of solids of at least one of the first and second suspensions.

21. The process in accordance with claim 20, further comprising:

mixing the second and third suspensions together; and supplying the mixture of the second and third suspensions to the first suspension.

22. The process in accordance with claim 21, wherein the adjusting further includes combining a fourth suspension to at least one of the second and third suspension.

23. The process in accordance with claim 22, wherein the adjusting further includes combining a fifth suspension to at least one of the second, third, and fourth suspensions.

24. The process in accordance with claim 23, wherein said first suspension comprises pulp slurry, said second suspension comprises a fiber content having a high shrinkage tendency, said third suspension comprises a fiber content having a low shrinkage tendency, said fourth suspension comprises a weighting agent content, and said fifth suspension comprises a retention agent.

25. The process in accordance with claim 20, further comprising:

mixing the second and first suspension together;

supplying the mixture of the first and second suspensions to the headbox; and supplying the third suspension to the headbox.

26. The process in accordance with claim 20, wherein the third suspension comprises at least one of clarified filtrate, clarified water, and a diluted retention agent to said first suspension.

27. The process in accordance with claim 20, wherein the second suspension comprises backwater.

28. The process in accordance with claim 20, wherein the adjusting further includes combining a fourth suspension to at least one of the second and third suspension.

29. The process in accordance with claim 28, wherein the adjusting further includes combining a fifth suspension to at least one of the second, third, and fourth suspensions.

30. The process in accordance with claim 29, wherein said first suspension comprises pulp slurry, said second suspension comprises a fiber content having a high shrinkage tendency, said third suspension comprises a fiber content having a low shrinkage tendency, said fourth suspension comprises a weighting agent content, and said fifth suspension comprises a retention agent.

* * * * *